US005407773A

United States Patent [19]

Furuta et al.

[11] Patent Number: 5,407,773

[45] Date of Patent: Apr. 18, 1995

[54] THERMAL FIXING-TYPE DEVELOPER MATERIAL FOR ELECTROPHOTOGRAPHY

[75] Inventors: Harumi Furuta; Seiji Ohta; Hajime Inagaki; Mituhiko Onda; Toshinobu Abiru, all of Kuga, Japan

[73] Assignee: Mitsui Petrochemical Industries, Ltd., Tokyo, Japan

[21] Appl. No.: 137,015

[22] PCT Filed: Feb. 17, 1993

[86] PCT No.: PCT/JP93/00194

§ 371 Date: Oct. 15, 1993

§ 102(e) Date: Oct. 15, 1993

[87] PCT Pub. No.: WO93/16416

PCT Pub. Date: Aug. 19, 1993

[30] Foreign Application Priority Data

Feb. 17, 1992 [JP] Japan ..... 4-029277

[51] Int. Cl.[6] ..... G03G 9/087

[52] U.S. Cl. ..... 430/110; 430/99

[58] Field of Search ..... 430/110, 109, 106, 99

[56] References Cited

U.S. PATENT DOCUMENTS

| | | | |
|---|---|---|---|
| 4,535,049 | 8/1985 | Honda et al. | 430/110 |
| 4,556,624 | 10/1985 | Gruber et al. | 430/110 |
| 4,810,612 | 3/1989 | Ueda et al. | 430/110 |
| 4,988,598 | 1/1991 | Tomono et al. | 430/99 |

FOREIGN PATENT DOCUMENTS

| | | |
|---|---|---|
| 0103967 | 3/1987 | European Pat. Off. . |
| 49-065232 | 6/1974 | Japan . |
| 60-230663 | 11/1985 | Japan . |
| 63-036263 | 2/1988 | Japan . |
| 1015754 | 1/1989 | Japan . |
| 1234857 | 9/1989 | Japan . |

OTHER PUBLICATIONS

Patent Abstract of Japan, vol. 9, No. 50 (P-339) (1773) 5 Mar. 1985 & JP-A-59 188 657 (Cannon K.K.) 26 Oct. 1984.

*Primary Examiner*—John Goodrow

*Attorney, Agent, or Firm*—Sherman and Shalloway

[57] ABSTRACT

A thermal fixing-type developer material for electrophotography comprising a propylene-α-olefin copolymer wax (A) having a number average molecular weight (Mn) in the range of from 7,000 to 12,000; a binder (B); and a colorant (C).

There is provided a thermal fixing-type developer material for electrophotography which, when used as a main component for an electrostatic toner, would provide a reprographic image which exhibits good release properties upon thermal fixing, a reduced adhesion to the heated roller or the photoreceptor, no offset or contamination, and a good fixing of the fixed image, and prevent the heated roll and the photoreceptor from undergoing contamination.

14 Claims, No Drawings

THERMAL FIXING-TYPE DEVELOPER MATERIAL FOR ELECTROPHOTOGRAPHY

TECHNICAL FIELD

The present invention is directed to a thermal fixing-type developer material for electrophotography. More specifically, the present invention is directed to a thermal fixing-type developer material for electrophotography which, when used as a main component for an electrostatic toner, is capable of providing a reprographic image which exhibits good release properties upon thermal fixing, a reduced adhesion to the heated roller or the photoreceptor, no offset or contamination, and a good fixing of the fixed image, and is capable of preventing the heated roll and the photoreceptor from undergoing a contamination.

BACKGROUND ART

In electrostatography, an electrostatic toner, which is a developer material for electrophotography is used for developing a visible image from a latent image which has been created by application of a charge pattern on the surface of a photoreceptor. An electrostatic toner is a finely divided chargeable powder which may comprise a resin having dispersed therein a coloring agent such as a pigment or carbon black. Electrostatic toners may be categorized into dry two-component toners which are used with a carrier such as iron powder or glass particles; wet toners which comprise a dispersion system in an organic solvent such as isoparafin; and dry one-component toners wherein a magnetic finely divided powder is dispersed.

The image which has been developed on the photoreceptor with the electrostatic toner is transferred onto a paper from the photoreceptor, and on the paper, the image is fixed by means of heat or a vaporized solvent. In the case of an image which has been directly developed on a paper having disposed thereon a sensitizing layer, the image is fixed by means of heat or a vaporized solvent with no further transfer. Among various methods of fixing, fixing of an image using a heated roller is an advantageous method since it is a contact fusing at a high thermal efficiency which may enable a reliable fixing of the image even by using a heat source at a relatively low temperature, and since such a method is adequate for a high-speed reprography.

However, when a conventional electrostatic toner is used and the image is fixed onto a paper by bringing a heated body such as a heated roller into contact with the image, a phenomenon called offset is likely to be induced. When such offset is induced, a part of the image becomes adhered to the heated body and the thus adhered image is then transferred onto the part of the paper where subsequent portion of the image is transferred. In particular, in a high-speed reprography wherein the temperature of the heated body must be elevated to increase fixing efficiency and fixing rate, such offset phenomenon is more likely to be induced. In view of such a situation, in the case of fixing an image created by a one-component electrostatic toner using a heated roller, the roller surface is often impregnated with or fed with a silicone oil to thereby avoid such an offset phenomenon from being induced. Such a countermeasure, however, may induce another problem that the roller may become susceptible for contamination.

For a binder, which is one of the main components in the electrostatic toner, various thermoplastic resins have been employed. Among such thermoplastic resins which have been employed for the binder, low-molecular weight styrene-(meth)acrylate copolymers have the merits that they are highly chargeable; that they exhibit an excellent fixing owing to their adequate softening point (approx. 100° C.); that cleaning of the photoreceptor is easy and the photoreceptor is less susceptible to contamination; that they are less hygroscopic; that they may be sufficiently mixed with carbon black which is the colorant; and that they may be readily pulverized. However, such conventional electrostatic toners prepared by using a low-molecular weight styrene-(meth-)acrylate copolymer may still suffer from the offset phenomenon when they are used in the high-speed reprography.

In order to obviate the above-described problems, inclusion in the electrostatic toner of a polyolefin wax as a releasing agent has been proposed (Japanese Patent Publication Nos. 52(1977)-3304, 52(1977)-3305, 57(1982)-52574, 58(1983)-58664, and Japanese Patent Application Kokai No. 58(1983)-59455).

Even when the techniques described in the above-mentioned Japanese Patent Publication No. 52(1977)-3304 and the like are used, various problems are still induced since the properties of the polyolefin wax as a releasing agent are not fully exerted. For example, when a polyolefin wax of a relatively low molecular weight is used for the releasing agent, release properties upon thermal fixing and resistance to low-temperature offset phenomenon of the resulting toner may be improved while fixing to the paper of the fixed image would become poor due to the low mechanical strength of the wax itself. On the contrary, use of a high-molecular weight wax would result in an improved fixing to the paper of the fixed image and an improved resistance to high-temperature offset of the resulting toner. The resistance to low-temperature offset, however, would become poor due to an increase in softening point.

DISCLOSURE OF THE INVENTION

In view of the above-described situation, an object of the present invention is to provide a developer material for electrophotography of thermal fixing-type which, when used as a main component in an electrostatic toner, is capable of providing a reprographic image which exhibits good release properties upon thermal fixing, a reduced adhesion to the heated roller or the photoreceptor, no offset or contamination, and a good fixing of the fixed image, and is capable of preventing the heated roll and the photoreceptor from undergoing a contamination.

The inventors of the present invention have made an intensive study in order to obviate the above-described problems, and found out that a developer material wherein the above-mentioned properties are well-balanced may be prepared by using as a release agent a propylene-$\alpha$-olefin copolymer wax having a molecular weight within the predetermined range and an $\alpha$-olefin content which may vary in accordance with the molecular weight. The present invention has been completed upon such a finding.

According to the present invention, there is provided a thermal fixing-type developer material for electrophotography comprising a propylene-$\alpha$-olefin copolymer wax (A) having a number average molecular weight (Mn) in the range of from 7,000 to 12,000; a binder (B); and a colorant (C).

The propylene-α-olefin copolymer wax (A) may preferably comprise a lower-molecular weight portion having an average α-olefin content $X_L$ and the remaining higher-molecular weight portion having an average α-olefin content $X_H$, and a ratio $X_R$ of $X_L/X_H$ may preferably be in the range of from 1.80 to 2.50.

BEST MODE FOR CARRYING OUT THE INVENTION

The thermal fixing-type developer material for electrophotography according to the present invention (hereinafter referred to as "developer material of the invention") is hereinafter described in detail.

The propylene-α-olefin copolymer wax (A) is prepared by copolymerizing propylene with at least one member selected from ethylene and α-olefins having 4 to 6 carbon atoms. Exemplary α-olefins having 4 to 6 carbon atoms include butene-1, pentene-1, and hexene-1. The propylene-α-olefin copolymer (A) may preferably have a propylene content of at least 90% by mole since the thermal fixing-type developer material for electrophotography prepared by using such a copolymer may have a low melting point as well as good release properties.

The propylene-α-olefin copolymer wax (A) may have a number average molecular weight (Mn) in the range of from 7,000 to 12,000, and preferably, from 7,500 to 10,000. In the present invention, the number average molecular weight Mn is measured by vapor pressure osmometry (VPO) by dissolving the propylene-α-olefin copolymer wax in p-xylene at 95° C. and using benzil for the standard.

The propylene-α-olefin copolymer employed may generally have a density in the range of from about 0.88 to 0.93 g/cm$^3$; crystallinity in the range of from about 50 to 75%, and preferably from about 55 to 70%; melting point in the range of from about 125° to 165° C., and preferably from 30° to 160° C.; and a softening point in the range of from about 135° to 175° C., and preferably from 140° to 170° C. In the present invention, the density is measured in accordance with JIS K6760, the crystallinity is measured by X-ray diffraction, the melting point is measured by DSC, and the softening point is measured by JIS K2207.

The propylene-α-olefin copolymer wax (A) may preferably comprise a lower-molecular weight portion and the remaining higher-molecular weight portion, and have a ratio $X_R$ of $X_L/X_H$ in the range of from 1.80 to 2.50, and more preferably from 1.80 to 2.40, $X_L$ representing an average α-olefin Content of the lower-molecular weight portion and $X_H$ representing an average α-olefin content of the remaining higher-molecular weight portion. The thermal fixing-type developer material for electrophotography prepared by using such a propylene-α-olefin copolymer wax (A) has an improved low-temperature fixing and toner flowability. In the present invention, the term, α-olefin content designates the content of ethylene and α-olefins having four to six carbon atoms, that is, the content of α-olefins other than propylene. In the present invention, the ratio ($X_R=X_L/X_H$) of the average α-olefin content $X_L$ of the lower-molecular weight portion to the average α-olefin content $X_H$ of the remaining higher-molecular weight portion is measured by subjecting the propylene-α-olefin copolymer to high temperature-gel permeation chromatography (GPC) to fractionate the copolymer in terms of their molecular weight, and subsequently, measuring Fourier transform infrared spectrum (FT-IR) of respective fractions by allowing the fractionated sample to flow through the flow cell to thereby continuously determine the α-olefin content of the fractions. After depicting a GPC chromatogram by using the data, the portion which comprise 30% in area in the total area of the chromatogram is designated the lower-molecular weight portion, and its average α-olefin content ($X_L$) is determined, and the remaining portion of the chromatogram comprising 70% in area in the total area is designated the higher-molecular weight portion, and its average α-olefin content ($X_H$) is determined to finally calculate the rate $X_R$ of $X_L/X_H$ therefrom.

When the propylene-α-olefin copolymer wax (A) is a propylene-ethylene copolymer wax, it may preferably have an isotacticity (Iso) of at least 88% since use of a propylene-ethylene copolymer wax having such an isotacticity is effective for preventing the heated roller and the photoreceptor from being contaminated. In the present invention, the isotacticity (Iso) is measured by means of $^{13}$C-NMR spectrum as will be described later.

The propylene-α-olefin copolymer wax (A) as described above may be prepared, for example, either by thermal degradation of a high-molecular weight propylene-α-olefin copolymer or by direct preparation of the copolymer having a number average molecular weight within the above-described range by copolymerizing the propylene with the α-olefin. Preparation by thermal degradation is preferred for an efficient production of the propylene-α-olefin copolymer wax (A) at a high yield.

The thermal degradation may be carried out, for example, by feeding a high-molecular weight propylene-α-olefin copolymer having a melt index of about 20 into an extruder and melt-extruding the copolymer at a temperature of from 350° to 450° C. The extruder employed is not limited to any particular type, and may be either a single-screw extruder or a multi-screw extruder having two or more screws. In addition, the thermal degradation may preferably be carried out in an inert atmosphere.

The high-molecular weight propylene-α-olefin copolymer which is thermally degraded may be adequately selected so that the propylene-α-olefin copolymer of desired type may be produced. Among such propylene-α-olefin copolymers, those having a propylene content of 90% by mole or higher are preferred in view of the low melting point and the good release properties of the resulting propylene-α-olefin copolymer (A).

Such a high-molecular weight propylene-α-olefin copolymer may be produced by copolymerizing propylene with an α-olefin in the presence of an olefin-polymerizing catalyst comprising [I] a transition metal compound catalyst component, [II] an organometal compound catalyst component containing a metal selected from Groups I to III in the periodic table, and optionally [III] an electron donor.

Exemplary transition metal compounds which may be used for the catalyst component [I] include compounds containing a transition metal selected from the elements of Groups III to VIII in the periodic table. Among such compounds, those containing at least one transition metal selected from Ti, Zr, Hf, Nb, Ta, Cr and V are preferred.

For such a transition metal compound catalyst component [I], known catalytic components may be used such as solid titanium catalyst components containing titanium and a halogen, for example, a solid titanium catalyst component [I-1] containing titanium, magnesium, and a halogen, and preferably, an electron donor (a).

Such a solid titanium catalyst component [I-1] may be prepared in accordance with the procedure described in, for example, Japanese Patent Publication No. 57(1982)-26613, Japanese Patent Publication No. 61(1986)-5483, Japanese Patent Application Kokai No. 56(1981)-811, Japanese Patent Publication No. 60(1985)-37804, Japanese Patent Publication No. 56(1981)-39767, Japanese Patent Application Kokai No. 53(1978)-146292, Japanese Patent Application Kokai No. 57(1982)-63310, Japanese Patent Application Kokai No. 62(1987)-273206, Japanese Patent Application Kokai No. 63(1988)-69804, Japanese Patent Application Kokai No. 60(1985)-23404, Japanese Patent Application Kokai No. 58(1983)-196210, Japanese Patent Application Kokai No. 64(1989)-54005, Japanese Patent Application Kokai No. 59(1984)-149905, Japanese Patent Application Kokai No. 61(1986)-145206, Japanese Patent Application Kokai No. 1(1989)-168707, Japanese Patent Application Kokai No. 62(1987)-104810, and the like.

In one typical process for preparing the solid titanium catalyst component [I-1], a tetravalent titanium compound represented by the following formula (1):

$$Ti(OR)_gX_{4-g} \quad (1)$$

[wherein $R^1$ is a hydrocarbon group, X is a halogen atom, and g is an integer of $0 \leqq g \leqq 4$], a magnesium compound, and preferably, an electron donor (a) are used for the catalyst preparation, and these compounds are brought in contact with each other to allow for a reaction to take place.

Typical tetravalent titanium compounds represented by the formula (1) include tetrahalogenated titaniums such as $TiCl_4$, $TiBr_4$, $TiI_4$, etc.; trihalogenated alkoxy titaniums such as $Ti(OCH_3)Cl_3$, $Ti(OC_2H_5)Cl_3$, $Ti(O\text{-}n\text{-}C_4H_9)Cl_3$, $Ti(OC_2H_5)Br_3$, $Ti(O\text{-}iso\text{-}C_4H_9)Br_3$, etc.; dihalogenated dialkoxy titaniums such as $Ti(OCH_3)_2Cl_2$, $Ti(OC_2H_5)_2Cl_2$, $Ti(O\text{-}n\text{-}C_4H_9)_2C_2$, $Ti(OC_2H_5)_2Br_2$, etc.; monohalogenated trialkoxy titaniums such as $Ti(OCH_3)_3Cl$, $Ti(OC_2H_5)_3Cl$, $Ti(O\text{-}n\text{-}C_4H_9)_3Cl$, $Ti(OC_2H_5)_3Br$, etc.; tetraalkoxy titaniums such as $Ti(OCH_3)_4$, $Ti(OC_2H_5)_4$, $Ti(O\text{-}n\text{-}C_4H_9)_4$, $TiO\text{-}iso\text{-}C_4H_9)_4$, Ti(O-2-ethylhexyl)$_4$, etc. The above-mentioned tetravalent titanium compounds may be used either alone or in combination of two or more.

Among such tetravalent titanium compounds, the preferred are tetrahalogenated titaniums, and the most preferred is tetrachlorotitanium.

It should be noted that the tetravalent titanium compound may be used after diluting it with a hydrocarbon or a halogenated hydrocarbon.

The above-mentioned magnesium compound may be either a magnesium compound with reducing ability or a magnesium compounds with no reducing ability.

The magnesium compounds with reducing ability may typically be an organomagnesium compound represented by the following formula (2):

$$X_nMg(R^2)_{2-n} \quad (2)$$

[wherein n is an integer of $0 \leqq n < 2$; $R^2$ is hydrogen atom or an alkyl, an aryl, or a cycloalkyl group having 1 to 20 carbon atoms, with the proviso that when n is equal to 0, the two $R^2$ may be either the same or different; and X is a halogen atom].

Exemplary organomagnesium compounds include dialkyl magnesium compounds such as dimethyl magnesium, diethyl magnesium, dipropyl magnesium, dibutyl magnesium, diamyl magnesium, dihexyl magnesium, didecyl magnesium, octylbutylmagnesium, ethylbutyl magnesium, etc; alkyl magnesium halides such as ethyl magnesium chloride, propyl magnesium chloride, butyl magnesium chloride, hexyl magnesium chloride, amyl magnesium chloride, etc.; alkyl magnesium alkoxides such as butyl ethoxy magnesium, ethyl butoxy magnesium, octyl butoxy magnesium, etc.; butyl magnesium hydride; and the like.

Exemplary magnesium compounds with no reducing ability include halogenated magnesiums such as magnesium chloride, magnesium bromide, magnesium iodide, magnesium fluoride, etc.; alkoxy magnesium halides such as methoxy magnesium chloride, ethoxy magnesium chloride, isopropoxy magnesium chloride, butoxy magnesium chloride, octoxy magnesium chloride, etc.; aryloxy magnesium halides such as phenoxy magnesium chloride, methylphenoxy magnesium chloride, etc.; alkoxy magnesiums such as ethoxy magnesium, isopropoxy magnesium, butoxy magnesium, n-octoxy magnesium, 2-ethylhexoxy magnesium, etc.; aryloxy magnesiums such as phenoxy magnesium, dimethylphenoxy magnesium, etc.; and magnesium carboxylates such as magnesium laurate, magnesium stearate, etc. It is also possible to employ metal magnesium or hydrogenated magnesium.

The above-mentioned magnesium compounds with no reducing ability may be a derivative of the above-mentioned magnesium compounds with reducing ability, or a compound newly derived for the preparation of the solid titanium catalyst component [I-1]. To derive a magnesium compound with no reducing ability from a magnesium compound with reducing ability, the magnesium compound with reducing ability may be brought in contact with a polysiloxane compound, a halogen-containing silane compound, a halogen-containing aluminum compound, an ester, an alcohol, a halogen-containing compound, or a compound containing hydroxyl group or an active carbon-oxygen bond.

It should be noted that the above-mentioned magnesium compounds with and without reducing ability may be in the form of a complex or a double compound with the organometal compound which will be described later, for example, an aluminum, a zinc, a boron, a beryllium, a sodium, or a potassium compound; or a mixture with another metal compound. Furthermore, the magnesium compound may be used either alone or in combination of two or more, and either in liquid or solid state. When the magnesium compound is solid, it may be brought into liquid state by using an alcohol, a carboxylic acid, an aldehyde, an amine, or a metal acid ester, which will be described later as the electron donor (a).

The magnesium compounds which may be used for the preparation of the solid titanium catalyst component [I-1] are not limited to the above-mentioned compounds, and many other magnesium compounds may be used for such a purpose. However, use of a magnesium compounds which will be in the form of a halogen-containing magnesium compound in the final solid titanium catalyst component [I-1] is preferred. Accordingly, when a magnesium compound containing no halogen is used for the preparation of the solid titanium catalyst component [I-1], the magnesium compound may be preferably brought into contact with a halogen-containing compound in course of the preparation of the solid titanium catalyst component [I-1].

Among those magnesium compounds, a magnesium compound with no reducing ability is preferred, especially a halogen-containing magnesium compound is preferred. Furthermore, magnesium chloride, alkoxy magnesium chloride, and aryloxy magnesium chloride are preferred.

As mentioned above, an electron donor (a) is preferably employed for the preparation of the solid titanium catalyst component [I-1]. The electron donor (a) may typically be an oxygen-containing electron donor such as an alcohol, a phenol, a ketone, an aldehyde, a carboxylic acid, an organic acid halide, an ester of an organic or an inorganic acid, an ether, a diether, an acid amide, an acid anhydride, or alkoxy silane; or a nitrogen-containing electron donor such as an ammonia, an amine, a nitrile, a pyridine, or an isocyanate. Exemplary electron donors (a) include alcohols containing 1 to 18 carbon atoms such as methanol, ethanol, propanol, butanol, pentanol, hexanol, 2-ethylhexanol, octanol, dodecanol, octadecyl alcohol, oleyl alcohol, benzyl alcohol, phenylethyl alcohol, cumyl alcohol, isopropyl alcohol, isopropylbenzyl alcohol, etc.; halogen-containing alcohols containing 1 to 18 carbon atoms such as trichloromethanol, trichloroethanol, trichlorohexanol, etc.; phenols containing 6 to 20 carbon atoms which may have a lower alkyl group such as phenol, cresol, xylenol, ethylphenol, propylphenol, nonylphenol, cumylphenol, naphthol, etc.; ketones containing 3 to 15 carbon atoms such as acetone, methyl ethyl ketone, methyl isobutyl ketone, acetophenone, benzophenone, benzoquinone, etc.; aldehydes containing 2 to 15 carbon atoms such as acetoaldehyde, propionaldehyde, octyl aldehyde, benzaldehyde, tolualdehyde, naphthoaldehyde, etc.; esters of an organic acid containing 2 to 18 carbon atoms such as methyl formate, methyl acetate, ethyl acetate, vinyl acetate, propyl acetate, octyl acetate, cyclohexyl acetate, ethyl propionate, methyl butyrate, ethyl valerate, methyl chloroacetate, ethyl dichloroacetate, methyl methacrylate, ethyl crotonate, ethyl cyclohexanecarboxylate, methyl benzoate, ethyl benzoate, propyl benzoate, butyl benzoate, octyl benzoate, cyclohexyl benzoate, phenyl benzoate, benzyl benzoate, methyl toluiate, ethyl toluiate, amyl toluiate, ethyl ethyl-benzoate, methyl anisate, ethyl anisate, ethyl ethoxy-benzoate, γ-butyrolactone, δ-valerolactone, coumarine, phthalide, ethyl carbonate, etc.; acid halides containing 2 to 15 carbon atoms such as acetyl chloride, benzoyl chloride, toluil chloride, anisil chloride, etc.; ethers containing 2 to 20 carbon atoms such as methyl ether, ethyl ether, isopropyl ether, butyl ether, amyl ether, tetrahydrofuran, anisole, diphenyl ether, etc.; acid amides such as N,N-dimethylacetoamide, N,N-diethyl banzamide, N,N-dimethyltoluilamide, etc.; amines such as trimethylamine, triethylamine, tributylamine, tribenzylamine, tetramethylethylenediamine, etc; nitriles such as acetonitrile, benzonitrile, trinitrile, etc.; pyridines such as pyridine, methylpyridine, ethylpyridine, dimethylpyridine, etc.; and acid anhydrides such as acetic anhydride, phthalic anhydride, benzoic anhydride, etc.

Among the esters of an organic acid, the preferred are esters of a polyvalent carboxylic acid having a backbone represented by the following general formulae (3) to (5):

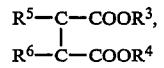

(3)

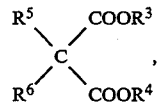

(4)

and

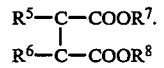

(5)

In the above formulae (3) to (5), $R^3$ is a substituted or unsubstituted hydrocarbon group; and $R^4$, $R^7$ and $R^8$ are hydrogen atom or a substituted or unsubstituted hydrocarbon group. $R^5$ and $R^6$ are hydrogen atom or a substituted or unsubstituted hydrocarbon group. Preferably, at least one of $R^5$ and $R^6$ is a substituted or unsubstituted hydrocarbon group. Also, $R^5$ and $R^6$ may together form a cyclic structure. Furthermore, when $R^3$, $R^4$, $R^5$, $R^6$, $R^7$ or $R^8$ is a substituted hydrocarbon group, the substituent may be the one containing a heteroatom such as N, O or S, for example, a group such as —C—O—C—, —COOR, —COOR, —OH, —$SO_3H$, —C—N—C—, or —$NH_2$.

Such esters of a polyvalent carboxylic acid may typically be aliphatic polycarboxylates, alicyclic polycarboxylates, aromatic polycarboxylates, or heterocyclic polycarboxylates.

Preferred exemplary esters of a polyvalent carboxylic acid include n-butyl maleate, diisobutyl methylmalonate, di-n-hexyl cyclohexenecarboxylate, ethyl nadiate, diisopropyl tetrahydrophthalate, diethyl phthalate, diisobutyl phthalate, n-butyl phthalate, di-2-ethylhexyl phthalate, dibutyl 3,4-furandicarboxylate.

The most preferred polyvalent carboxylates are esters of a phthalic acid.

The polyether compound may typically be a compound represented by the following general formula (6):

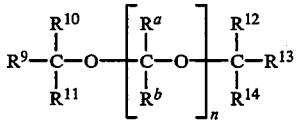

(6)

wherein $R^9$, $R^{10}$, $R^{11}$, $R^{12}$, $R^{13}$, $R^{14}$, $R^a$ and $R^b$ are substituents containing at least one element selected from carbon, hydrogen, oxygen, a halogen, nitrogen, sulfur, phosphor, boron, and silicon, and $R^9$, $R^{10}$, $R^{11}$, $R^{12}$, $R^{13}$, $R^{14}$, $R^a$ and $R^b$, and preferably $R^a$ and $R^b$, may together form a cyclic structure other than benzene ring; and n is an integer of $1 \leqq n \leqq 5$. The backbone may contain an atom other than carbon.

Preferred exemplary polyether compounds include 2,2-diisobutyl-1,3-dimethoxypropane, 2-isopropyl-2-isopentyl1,3-dimethoxypropane, 2,2-dicyclohexyl-1,3-dimethoxypropane, and 2,2-bis (cyclohexylmethyl) -1,3-dimethoxypropane.

The electron donor (a) as described above may be employed in combination of two or more.

In the preparation of the solid titanium catalyst component [I-1], an organic or an inorganic compound containing silicon, phosphor, aluminum, or the like, which may function as a carrier compound or a reaction auxiliary, may be brought into contact with the titanium compound, the magnesium compound, and the optionally employed electron donor (a).

Such carrier compounds which may be employed include $Al_2O_3$, $SiO_2$, $B_2O_3$, MgO, CaO, $TiO_2$, ZnO, $SnO_2$, BaO, ThO, and resins such as a styrene-divinylbenzene copolymer, which may be employed either alone or in combination of two or more. Among these, the preferred are $Al_2O_3$, $SiO_2$ and the styrene-divinylbenzene copolymer.

The process for preparing the solid titanium catalyst component [I-1] is not limited to any particular process. Typical processes, however, are briefly described in the following.

(1) A solution comprising the magnesium compound, the electron donor, and a hydrocarbon solvent is brought into contact with an organometal compound to precipitate a solid. The solution is brought into contact with the titanium compound either during or after the precipitation.

(2) A complex comprising the magnesium compound and the electron donor (a) is brought into contact with an organometal compound. The reaction product is then brought into contact with the titanium compound.

(3) An inorganic carrier is brought into contact with the organomagnesium compound, and the reaction product is brought into contact with the titanium compound, and preferably, with the electron donor (a). In this process, the reaction product of the inorganic carrier and the organomagnesium compound may be preliminarily brought into contact with a halogen-containing compound and/or an organometal compound.

(4) A solution comprising the magnesium compound, the electron donor (a), and optionally, a hydrocarbon solvent is mixed with the inorganic or organic carrier to produce the inorganic or organic carrier having loaded thereto the magnesium compound. The thus loaded carrier is then brought into contact with the titanium compound.

(5) A solution comprising the magnesium compound, the titanium compound, the electron donor (a), and optionally, a hydrocarbon solvent is brought into contact with the inorganic or organic carrier to produce a solid titanium catalyst component having loaded thereto the magnesium and the titanium.

(6) The organomagnesium compound in liquid state is brought into contact with the titanium compound containing a halogen.

(7) The organomagnesium compound in liquid state is brought into contact with a halogen-containing compound, and then, with the titanium compound.

(8) The magnesium compound containing an alkoxy group is brought into contact with the titanium compound containing a halogen.

(9) A complex comprising the magnesium compound containing an alkoxy group and the electron donor (a) is brought into contact with the titanium compound.

(10) A complex comprising the magnesium compound containing an alkoxy group and the electron donor (a) is brought into contact with an organometal compound, and then, with the titanium compound.

(11) The magnesium compound, the electron donor (a), and the titanium compound are brought into contact with each other in an arbitrary order. In this process, each component may be subjected to a preliminary treatment by using the electron donor (a) and/or an organometal compound, or by using a reaction auxiliary such as a halogen-containing silicon compound. It should also be noted that, in this process, it would be preferable to employ the electron donor (a) at least in one step.

(12) The magnesium compound having no reducing ability in liquid state is reacted with the titanium compound in liquid state preferably in the presence of the electron donor (a) to precipitate a solid magnesium-titanium complex.

(13) The reaction product obtained in (12) is further reacted with the titanium compound.

(14) The reaction product obtained in (11) or (12) is further reacted with the electron donor (a) and the titanium compound.

(15) A solid product produced by pulverizing the magnesium compound and the titanium compound is treated with a member selected from a halogen, a halogen compound and an aromatic hydrocarbon, preferably in the presence of the electron donor (a). When the electron donor (a) is present, the electron donor (a) may be present in the form of a complex with the magnesium compound, and the complex may be pulverized. When the electron donor (a) is not present, the magnesium compound may be pulverized either alone or with the titanium compound. The pulverized product may be preliminarily treated with a reaction auxiliary before treating with the halogen. The reaction auxiliary which may be used include an organometal compound and a halogen-containing silicon compound.

(16) The magnesium compound is pulverized, and the pulverization product is brought into contact with the titanium compound to allow for a reaction to proceed. The pulverization and/or the contact reaction may preferably be carried out in the presence of the electron donor (a) or a reaction auxiliary.

(17) The compound produced in any of the above (11) to (16) is treated with a halogen, a halogen compound, or an aromatic hydrocarbon.

(18) The organomagnesium is brought into contact with a halogen-containing compound and a metal oxide, and the reaction product is brought into contact with the titanium compound, and preferably, with the electron donor (a).

(19) The magnesium compound such as a magnesium salt of an organic acid, an alkoxymagnesium, and an aryloxymagnesium is reacted with the titanium compound and/or a halogen-containing hydrocarbon and preferably, with the electron donor.

(20) A solution of at least the magnesium compound and the alkoxytitanium in a hydrocarbon is brought into contact with the titanium compound and/or the electron donor (a). Such a contact may preferably be conducted in the presence of a halogen-containing compound such as a halogen-containing silicon compound.

(21) The magnesium compound having no reducing ability in liquid state is reacted with an organometal compound to precipitate a solid magnesium-metal (aluminum) complex, and the complex is reacted with the electron donor (a) and the titanium compound. The preparation of the solid titanium catalyst component [I-1] as described above is generally carried out at a temperature in the range of from −70° C. to 200° C., and preferably, from −50° C. to 150° C.

The thus produced solid titanium catalyst component I-1] contains titanium, magnesium, a halogen, and preferably, the electron donor (a).

In the solid titanium catalyst component [I-1], the ratio (atomic ratio) of the halogen to the titanium is in the range of from 2 to 200, and preferably, from 4 to 90, and the ratio (atomic ratio) of the magnesium to the titanium is in the range of from 1 to 100, and preferably, from 2 to 50.

When the solid titanium catalyst component [I-1 ], contains the electron donor (a) , the catalyst component [I1] may contain the electron donor (a) at a ratio (molar ratio) of the electron donor (a) to the titanium of from 0.01 to 100, and preferably at a ratio of from 0.05 to 50.

The above description of the solid titanium catalyst component [I-1] has been directed to the cases wherein the titanium compound are used. However, titanium in the above-described titanium compounds may be substituted with zirconium, hafnium, vanadium, niobium, tantalum, or chromium.

Next, the organometal compound catalyst component [II] containing a metal selected from Groups I to III in the periodic table, which is a component constituting the polymerization catalyst, is described.

The organometal compound catalyst component [II ] may typically be an organoaluminum compound [II-1], an alkylated complex compound of Group I metal and aluminum, or an organometal compound of a Group II metal.

The above-mentioned organoaluminum compound [II-1] may typically be a compound represented by the following formula (7).

$$(R^{15})_mAl(X)_{3-m} \quad (7)$$

In the formula (7), $R^{15}$ is a hydrocarbon group having 1 to 12 carbon atoms such as an alkyl, a cycloalkyl, or an aryl group, for example, methyl, ethyl, n-propyl, isopropyl, isobutyl, pentyl, hexyl, octyl, cyclopentyl, cyclohexyl, phenyl, or tolyl; X is a halogen atom or hydrogen; and m is an integer of from 1 to 3.

Exemplary organoaluminum compounds [II-1] include trialkylaluminums such as trimethylaluminum, triethylaluminum, triisopropylaluminum, triisobutylaluminum, trioctylaluminum, tri(2-ethylhexyl)aluminum, etc.; alkenylaluminums such as isopropenylaluminum, etc.; dialkylaluminum halides such as dimethylaluminum chloride, diethylaluminum chloride, diisopropylaluminum chloride, diisobutylaluminum chloride, dimethylaluminum bromide, etc.; alkylaluminum sesquihalides such as methylaluminum sesquichloride, ethylaluminum sesquichloride, isopropylaluminum sesquichloride, butylaluminum sesquichloride, ethylaluminum sesquibromide, etc.; alkylaluminum dihalides such as methylaluminum dichloride, ethylaluminum dichloride, isopropylaluminum dichloride, ethylaluminum dibromide, etc.; alkylaluminum hydrides such as diethylaluminum hydride, diisobutylaluminum hydride, etc.

The above-mentioned organoaluminum compound [II-1] may also be a compound represented by the following formula (8):

$$(R^{15})_hAl(Y)_{3-h} \quad (8).$$

In the above formula (8), $R^{15}$ is the same as the case of the formula (7); h is either 1 or 2; Y is a group represented by the formula (8-a) to (8-f):

$$-OR^{16} \quad (8\text{-a}),$$

$$-OSi(R^{17})_3 \quad (8\text{-b}),$$

$$-OAl(R^{18})_2 \quad (8\text{-c}),$$

$$-N(R^{19})_2 \quad (8\text{-d}),$$

$$-Si(R^{20})_3 \quad (8\text{-e}), \text{ and}$$

$$-N(R^{21})Al(R^{22})_2 \quad (8\text{-f}),$$

wherein $R^{16}$, $R^{17}$, $R^{18}$ and $R^{22}$ represent, for example, methyl group, ethyl group, isopropyl group, isobutyl group, cyclohexyl group, or phenyl group; $R^{19}$ represents, for example, hydrogen, methyl group, ethyl group, isopropyl group, phenyl group, or trimethylsilyl group; and $R^{20}$ and $R^{21}$ represent, for example, methyl group or ethyl group.

Exemplary organoaluminum compounds [II-1] include the following compounds:

(i) $(R^{15})_hAl(OR^{16})_{3-h}$ dimethylaluminum methoxide, diethylaluminum ethyoxide, diisobutylaluminum methoxide, etc.;

(ii) $(R^{15})_hAl(OSiR^{17}{}_3)_{3-h}$ $Et_2Al(OSiMe_3)$, $(iso\text{-}Bu)_2Al(OSiMe_3)$, $(iso\text{-}Bu)_2Al(OSiEt_3)$, etc.;

(iii) $(R^{15})_hAl(OAlR^{18}{}_2)_{3-h}$ $Et_2AlOAlEt_2$, $(iso\text{-}Bu)_2AlOAl(iso\text{-}Bu)_2$, etc.;

(iv) $(R^{15})_hAl(NR^{19}{}_2)_{3-h}$ $Me_2AlNEt_2$, $Et_2AlNHMe$, $Me_2AlNHEt$, $Et_2AlN(Me_3Si)_2$, $(iso\text{-}Bu)_2AlN(Me_3Si)_2$, etc.;

(v) $(R^{15})_hAl(SIR^{20}{}_3)_{3-h}$; $(iso\text{-}Bu)_2AlSiMe_3$, etc; and (vi) $(R^{15})_hAl[N(R^{21})—AlR^{22}{}_2]_{3-h}$ $Et_2AlN(Me)—AlEt_2$, $(iso\text{-}Bu)_2AlN(Et)Al(iso\text{-}Bu)_2$, etc.

Among the above-mentioned organoaluminum compounds, the preferred are the organoaluminum compounds represented by $(R^{15})_3Al$, $(R^{15})_hAl(OR^{16})_{3-h}$, and $(R^{15})_hAl(OAlR^{18}{}_2)_{3-h}$.

The alkylated complex compound of a metal of Group I and aluminum may typically be a compound represented by the general formula (9):

$$M^1Al(R^{23})_4 \quad (9)$$

wherein $M^1$ is Li, Na, or K; and $R^{23}$ is a hydrocarbon group containing 1 to 15 carbon atoms.

Exemplary alkylated complex compound of a Group I metal and aluminum include $LiAl(C_2H_5)_4$, and $LiAl(C_7H_{15})_4$.

The organometal compound of a Group II metal may typically be a compound represented by the following general formula (10).

$$(R^{24})(R^{25})M^2 \quad (10)$$

In the formula (10), $R^{24}$ and $R^{25}$ are independently a hydrocarbon group having 1 to 15 carbon atoms or a halogen with the proviso that $R^{24}$ and $R^{25}$ are not simultaneously a halogen; and $M^2$ is Mg, Zn or Cd.

Exemplary organometal compounds of a Group II metal include diethyl zinc, diethyl magnesium, butylethyl magnesium, ethylmagnesium chloride, and butylmagnesium chloride.

The organoaluminum compound [II-1], the alkylated complex compound of a metal of Group I and aluminum, and the organometal compound of a Group II metal as described above, which are the organometal compound catalyst component [II], may be employed in combination of two or more.

If desired, the preparation of the high-molecular weight propylene-α-olefin copolymer by copolymerizing the propylene and the α-olefin in the presence of the above-described transition metal compound catalyst component [I] and the organometal compound catalyst component [II] may be carried out in the presence of the above-described electron donor (a) or an electron donor (b) which is described in the following.

The electron donor (b) may typically be an organosilicon compound represented by the following formula (12).

$$(R^{26})_kSi(OR^{27})_{4-k} \quad (12)$$

In the formula (12), $R^{26}$ and $R^{27}$ are independently a hydrocarbon group; and k is an integer of $0<k<4$.

Exemplary organosilicon compounds represented by the general formula (12) include trimethylmethoxysilane, trimethylethoxysilane, dimethyldimethoxysilane, dimethyldiethoxysilane, diisopropyldimethoxysilane, t-butylmethyldimethoxysilane, t-butylmethyldiethoxysilane, t-amylmethyldiethoxysilane, diphenyldimethoxysilane, phenylmethyldimethoxysilane, diphenyldiethoxysilane, bis-o-tolyldimethoxysilane, bis-m-tolyldimethoxysilane, bis-p-tolyldimethoxysilane, bis-p-tolyldiethoxysilane, bisethylphenyldimethoxysilane, dicyclohexyldimethoxysilane, cyclohexylmethyldimethoxysilane, cyclohexylmethyldiethoxysilane, ethyltrimethoxysilane, ethyltriethoxysilane, vinyltrimethoxysilane, methyltrimethoxysilane, n-propyltriethoxysilane, decyltrimethoxysilane, decyltriethoxysilane, phenyltrimethoxysilane, γ-chloropropyltrimethoxysilane, methyltriethoxysilane, ethyltriethoxysilane, vinyltriethoxysilane, t-butyltriethoxysilane, n-butyltriethoxysilane, iso-butyltriethoxysilane, phenyltriethoxysilane, γ-aminopropyltriethoxysilane, chlorotriethoxysilane, ethyltriisopropoxysilane, vinyltributoxysilane, cyclohexyltrimethoxysilane, cyclohexyltriethoxysilane, 2-norbornanetrimethoxysilane, 2-norbornanetriethoxysilane, 2-norbornanemethyldimethoxysilane, ethyl silicate, butyl silicate, trimethylphenoxysilane, methyltriallyloxysilane, vinyltris(β-methoxyethoxysilane), vinyltriacetoxysilane, dimethyltetraethoxydisiloxane, cyclopentyltrimethoxysilane, 2-methylcyclopentyltrimethoxysilane, 2,3-dimethylcyclopentyltrimethoxysilane, cyclopentyltriethoxysilane, dicyclopentyldimethoxysilane, bis(2-methylcyclopentyl)dimethoxysilane, bis(2,3-dimethylcyclopentyl)dimethoxysilane, dicyclopentyldiethoxysilane, tricyclopentylmethoxysilane, tricyclopentylethoxysilane, dicyclopentylmethylmethoxysilane, dicyclopentylethylmethoxysilane, hexenyltrimethoxysilane, dicyclopentylmethylethoxysilane, cyclopentyldimethylmethoxysilane, cyclopentyldiethylmethoxysilane, and cyclopentyldimethylethoxysilane. The organosilicon compound as described above may be used in combination of two or more.

Among these, the preferred are ethyltriethoxysilane, n-propyltriethoxysilane, t-butyltriethoxysilane, vinyltriethoxysilane, phenyltriethoxysilane, vinyltributoxysilane, diphenyldimethoxysilane, phenylmethyldimethoxysilane, bis-p-tolyldimethoxysilane, p-tolylmethyldimethoxysilane, dicyclohexyldimethoxysilane, cyclohexylmethyldimethoxysilane, 2-norbornanetriethoxysilane, 2-norbornanemethyldimethoxysilane, phenyltriethoxysilane, dicyclopentyldimethoxysilane, hexenyltrimethoxysilane, cyclopentyltriethoxysilane, tricyclopentylmethoxysilane, and cyclopentyldimetylmethoxysilane.

The compounds which may be used for the electron donor (b) also include nitrogen-containing electron donors such as 2,6-substituted pyperidines, 2,5-substituted pyperidines, substituted methylenediamines, for example, N,N,N',N'-tetramethylmethylenediamine, N,N,N',N'-tetraethylmethylenediamine, etc., substituted methylenediamines, for example, 1,3-dibenzylimidazolidine, 1,3-dibenzyl-2-phenylimidazolidine, etc.; phosphor-containing electron donors such as phosphites, for example, triethylphosphite, tri-n-propylphosphite, triisopropylphosphite, tri-n-butylphosphite, triisobutylphosphite, diethyl-n-butylphosphite, diethylphenylphosphite, etc.; and oxygen-containing electron donors such as 2,6-substituted tetrahydropyranes and 2,5-substituted tetrahydropyranes.

The above-described electron donors (b) may be used in combination of two or more.

In the preparation of the high-molecular weight propylene-α-olefin copolymer, the copolymerization of the propylene with the α-olefin may be carried out either by a liquid phase polymerization such as solution polymerization or suspension polymerization, or a gas phase polymerization. When the polymerization is carried out under slurry conditions, the reaction solvent employed may be either an inert organic solvent as described below or a liquid olefin which is liquid at the reaction temperature.

The inert solvents which may be employed include aliphatic hydrocarbons such as propane, butane, pentane, hexane, heptane, octane, decane, dodecane, kerosine, etc.; alicyclic hydrocarbons such as cyclopentane, cyclohexane, methylcyclopentane, etc.; aromatic hydrocarbons such as benzene, toluene, xylene, etc.; halogenated hydrocarbons such as ethylene chloride, chlorobenzene, etc.; and mixtures thereof. Among such inert solvents, the most preferred are aliphatic hydrocarbons.

In the preparation of the high-molecular weight propylene-α-olefin copolymer, the polymerization catalyst [I] is generally used in an amount of from about 0.001 to 100 millimoles, and preferably, from about 0.005 to 20 millimoles calculated in terms of the transition metal atom in the polymerization catalyst [I] per 1 liter of the volume polymerized. The organometal compound catalyst component [II] is generally used in an amount of from about 1 to 2,000 moles, and preferably, from about 2 to 500 moles calculated in term of the metal atom in the catalyst component [II] per 1 mole of the transition metal atom in the polymerization catalyst [I] in the polymerization system.

When the electron donor [III] is used, it is generally used in an amount of from about 0.001 to 10 moles, and preferably, from about 0.01 to 5 moles per 1 mole of the metal atom in the organometal compound catalyst component [II].

Hydrogen may be added during the polymerization in order to control the molecular weight of the resulting polymer to thereby produce a polymer having a high melt flow rate.

The polymerization may be generally carried out at a polymerization temperature of from about 20° to 300° C., and preferably, from about 50° to 150° C., and at a polymerization pressure of from normal pressure to 100 kg/cm$^2$, and preferably, from about 2 to 50 kg/cm$^2$. The polymerization temperature and the pressure, however, may differ in accordance with the type of the α-olefin employed.

Furthermore, the polymerization may be carried out in a batchwise, semi-continuous, or continuous process. Also, the polymerization may be carried out in two or more steps wherein the reaction conditions are altered.

The binder component (B) used for the thermal fixing-type developer material for electrophotography in accordance with the present invention is not limited to any particular type so long as it comprises a thermoplastic resin which can be admixed with such a developer material. The binder may comprise, for example, a styren polymer, a ketone resin, maleic acid resin, an aliphatic polyester resin, an aromatic polyester resin, a coumaron resin, a phenol resin, an epoxy resin, a terpen resin, a polyvinyl butyral, a polybutyl methacrylate, a polyvinyl chloride, a polyethylene, a polypropylene, a polybutadiene, and an ethylene-vinyl acetate copolymer. Among these, the preferred is the styrenic polymer, which has an adequate softening point (in the vicinity of 100° C.) as well as good fixing properties.

The styren polymer may typically be a polymer solely comprising a styren monomer or a copolymer of a styren monomer with other vinyl monomer. Exemplary styren monomers include styrene, p-chlorostyrene, and vinyl naphthalene. Exemplary of the other vinyl monomers include ethylenic unsaturated monoolefins such as ethylene, propylene, 1-butene, isobutene, etc.; halogenated vinyls such as vinyl chloride, vinyl bromide, vinyl fluoride, etc.; vinyl esters such as vinyl acetate, vinyl propionate, vinyl benzoate, etc.; α-methylene aliphatic monocarboxylates such as methyl acrylate, ethyl acrylate, n-butyl acrylate, isobutyl acrylate, n-octyl acrylate, dodecyl acrylate, 2-chloro-ethyl acrylate, phenyl acrylate, methyl α-chloroacrylate, methyl methacrylate, ethyl methacrylate, butyl methacrylate, etc.; nitriles and amides such as acrylonitrile, methacrylonitrile, acrylamide, etc.; vinyl ethers such as vinyl methyl ether, vinyl ethyl ether, vinyl propyl ether, vinyl isobutyl ether, etc.; vinyl ketones such as vinyl methyl ketone, vinyl hexyl ketone, methyl isopropenyl ketone, etc.; and N-vinyl compounds such as N-vinyl pyrrole, N-vinyl carbazole, N-vinyl indol, N-vinyl pyrrolidone, etc. Among such styren polymers, the preferred are those having a number average molecular weight (Mn) of at least 2,000, and the most preferred are those having a number average molecular weight (Mn) in the range of from 3,000 to 30,000. Furthermore, the styren polymer may preferably be those having a styrene content of at least 25% by weight.

The colorant component (C) used for the developer material in accordance with the present invention is not limited to any particular type so long as it may be admixed with the developer material. Exemplary colorants are such pigments and dyes as carbon black, phthalocyanine blue, aniline blue, arcooil blue, chrome yellow, ultramarine blue, quinoline yellow, lamp black, rose Bengal, diazo yellow, rhodamine B lake, carmine 6B, and quinacridone derivatives, which may be used either alone or in combination of two or more.

The colorant (C) may have admixed therewith an oil-soluble dye such as an azin Nigrosine, Induline, an azo dye, an anthraquinone dye, a triphenyl methane dye, a xanthene dye, or a pthalocyanine dye.

In preparing the developer material of the present invention, the above-described propylene-α-olefin copolymer wax (A), the binder (B), and the colorant (C) may generally be blended in propylene-α-olefin copolymer wax (A) / binder (B)/colorant (C) weight ratio of 1 to 20/100 / 1 to 20, and preferably, 1 to 10/100/1 to 10.

The developer material of the present invention may have blended therewith components other than the propylene-α-olefin copolymer wax (A), the binder (B), and the colorant (C) in an amount that would not adversely affect the merits of the present invention. Such additional components include charge control agents and plasticizer.

The developer material of the present invention may be used as a main component for either a two-component electrostatic toner or a one-component electrostatic toner. When the developer material of the present invention is used as a main component for the two-component electrostatic toner, the two-component electrostatic toner may be prepared by mixing the above-described propylene-α-olefin olefin copolymer wax (A) , the binder (B) , the colorant (C), and other optional components by a known method with a ball mill, an attritor or the like; subsequently kneading the mixture with a heated twin roll, a heated kneader, an extruder, or the like; cooling the kneaded product to allow for solidification to take place; granulating the thus solidified product in a hammer mill or a crusher; finely dividing the product in a jet mill or a vibration mill, or in a ball mill or an attritor after admixing water with the product; classifying the particles to adjust their average particle size to the range of from 5 to 35 μm; and adding a carrier to the particles to thereby prepare the two-component electrostatic toner. The carrier employed may be a known carrier, and the carrier is not limited to any particular type. Exemplary carriers which may be employed include silica sand having a particle size in the range of from 200 to 700 μm, glass beads, iron spheres, magnetic powder material consisting of iron, nickel or cobalt magnetic.

In such a two-component electrostatic toner, the propylene-α-olefin copolymer wax (A) is blended in an amount of from 1 to 20 parts by weight, and preferably, in an amount of from 2 to 10 parts by weight per 100 parts by weight of the thermoplastic resin including the binder (B).

When the developed material of the present invention is used as a main component for the one-component toner, the one-component electrostatic toner may be prepared by treating the propylene-α-olefin copolymer wax (A) , the binder (B), the colorant (C), and other optional additives, other thermal plastic resin and magnetic powder material by the same method as preparing the two-component toner.

In such a one-component electrostatic toner, the propylene-α-olefin copolymer wax (A) is used in an amount of from 1 to 25 parts by weight, and preferably, in an amount of from 1 to 20 parts by weight per 100 parts by weight of the binder (B).

The magnetic powder material blended in the one-component electrostatic toner may typically be a finely divided magnetite powder having a particle size of up to 1 μm. However, metals such as cobalt, iron and nickel, alloys and oxides thereof, ferrite, and a mixture thereof in powder form may also be used. The magnetic powder material may generally be blended in the one-component electrostatic toner in an amount of from 40 to 120 parts by weight per 100 parts by weight of the total of the binder (B) and the magnetic powder material. When the magnetic powder material is blended in the toner in such an amount, the resulting toner may have a good charge retaining properties and have no blur in image, with no reducing a electrical resistance of the toner, as well as a softening point in an adequate range, and consequently, the toner will be adequately fixed to produce a clear image. The toner having the magnetic powder material blended in such an amount also has the required electrostatic value as well as a sufficient resistance to flying. If desired, a known charge control agent may be blended in the above-described two-component or one-component electrostatic toners.

Determination of the molecular weight dependency of the α-olefin content of the propylene-α-olefin copolymer wax by GPC-FTIR is set forth by referring to the case of a propylene-ethylene copolymer as an example.

The apparatus used for the determination is the one wherein thermostatic chamber of the GPC column is directly connected to the FTIR, and the fraction which has been separated in the GPC column in terms of the molecular weight is subsequently introduced into flow cell of the FTIR wherein the fraction is measured for its IR spectrum. In the determination, sampling is sequentially carried out at a period of 18 seconds, while the interferogram is integrated for 20 times.

In such an apparatus, 1,000 μl of the sample solution which has been adjusted to a concentration of 0.2% (w/v) is added to the column using o-dichlorobenzene for the mobile phase, at a column temperature of 140° C., and at a flow rate of 1 ml/min to obtain the data as described below for the fraction which elutes from the column in one period (which is hereinafter referred to as slice component $S_i$).

(i) Time elapsed after the introduction of the sample (retention time, hereinafter abbreviated as "$(RT)_i$").

(ii) Spectrum of transmitted light in the region of from 3000 to 2800 $cm^{-1}$ obtained at a resolution of 8 $cm^{-1}$ (hereinafter abbreviated as "$T_i$").

(iii) Ratio of absorbance at 2956 $cm^{-1}$ and absorbance 2928 $cm^{-1}$ (which corresponds to molar ratio of branched methyl group and methylene group; hereinafter referred to as "$(A/A)_i$".

The following values are calculated from the thus measured $(RT)_i$, Ti, and $(A/A)_i$.

(1) Molecular weight of respective slice component

A calibration curve wherein the molecular weight is plotted in relation to the retention time is prepared by using several standard polystyrene samples whose molecular weight is already known. Each slice component is evaluated for its molecular weight on the bases of the (RT)i of the slice component by referring to the calibration curve.

(2) Response sensitivity of the detector (height of the chromatogram; hereinafter referred to as "$H_i$")

Ratio of the spectrum Ti of the transmitted light of each slice component to the spectrum of the transmitted light of the solvent, which had been measured by preliminarily introducing the solvent under the same conditions, is calculated to thereby determine the spectrum of the transmitted light of the separated component itself, and the total areal intensity of the spectrum calculated therefrom is designated a response sensitivity of the detector ($H_i$).

(3) Ethylene content of respective slice component (hereinafter referred to as $C_i$)

Using several propylene-ethylene copolymers whose composition is already known, a calibration curve is depicted by plotting the ethylene content in relation to the (A/A):

$$(A/A) = \sum_i \left[ (A/A)_i \times \left( H_i / \sum_i H_i \right) \right], H_i \geqq 0.01$$

Each slice component is evaluated for its ethylene content ($C_i$) on the basis of its $(A/A)_i$ by referring to the calibration curve.

Next, a chromatogram is depicted on the basis of the molecular weight and the ethylene content of respective slice components which had been determined by the above-described procedures (1) to (3). An average ethylene content ($X_L$) Of the lower-molecular weight slice components ($S^L{}_i$) which constitute 30% in area of the total area, as well as an average ethylene content ($X_H$) of the remaining slice components ($S^H{}_i$) are calculated by the following formulae:

$$X_L = \sum_i \left[ C^{Li} \times \left( H^{Li} / \sum_i H^{Li} \right) \right], (H^{Li} \geqq 0.01)$$

$$X_H = \sum_i \left[ C^{Hi} \times \left( H^{Hi} / \sum_i H^{Hi} \right) \right], (H^{Hi} \geqq 0.01)$$

Next, determination of isotacticity (Iso) by $^{13}C$-NMR is set forth by referring to the case of a vinyl polymer as an example. In the case of the vinyl polymer, tacticity is defined by means of two or more monomer units. For example, there are presumed m (meso) and r (racemo) tactic structures for a tactic dyad, and mm, mr and rr tactic structures for a tactic triad, as shown in the following formulae:

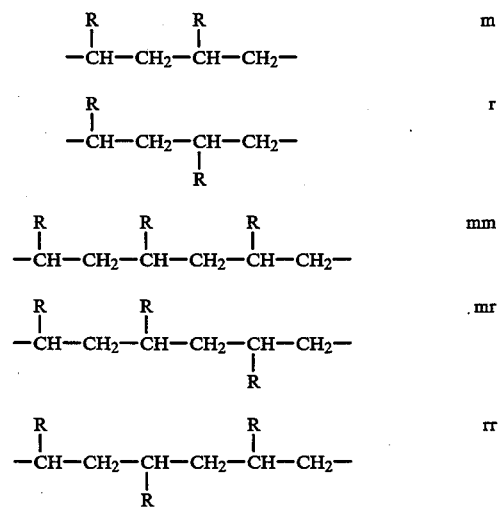

The term, isotacticity (Iso) used herein designates the proportion of mm in the mm, mr, and rr structures of the propylene triad. Therefore, the isotacticity (Iso) can be represented by the following formula [1]:

$$\text{Iso} = S_{mm}/S_{Me(PPP)} \times 100 \quad [1]$$

$$(S_{Me}(\text{PPP}) = S_{mm} + S_{mr} + S_{rr})$$

wherein $S_{mm}$, $S_{mr}$, $S_{rr}$ and $S_{Me(PPP)}$ represent areal intensity of the absorption peaks which are attributed to methyl carbon of mm, mr and rr of the propylene triad, respectively, and represents areal intensity of the absorption peaks attributed to methyl carbon of all structures of the propylene triad, which are obtained by the $^{13}$C-NMR. It should be noted that, when a unit other than the propylene unit is linked to one end or opposite ends of a propylene unit, the particular unit should desirably be excluded from the determination of the Iso.

For example, the following relation:

$$S_{Me(PPP)}=S_{Me}-S_{Me(PPE)}-S_{Me(EPE)} \quad [2]$$

has been found to hold for a propylene-ethylene copolymer on the bases of the attribution of absorption peaks described in M. Kakugo et al., Macromolecules, 5, 1150 (1982), wherein $S_{Me}$, $S_{Me(PPE)}$, and $S_{Me(EPE)}$ respectively represent areal intensity of the absorption peaks attributed to all methyl carbons; areal intensity of the absorption peak attributed to methyl carbon of the central propylene unit in PPE triad; and areal intensity of the absorption peak attributed to methyl carbon of the central propylene unit in EPE triad. Therefore, the Iso may be determined by substituting the result for the corresponding term in the equation [1].

OPERATION

As described above, the propylene-α-olefin copolymer wax which is used as a main component for the developer material of the present invention has an α-olefin content of the lower-molecular weight portion which is higher than that of the higher-molecular weight portion. It is known for a propylene-α-olefin copolymer having an α-olefin content in the range of from 0 to 10% that a higher α-olefin content would generally result in a lower melting point. In the propylene-α-olefin copolymer wax of the present invention, components having a higher α-olefin content, namely, components of a lower melting points are contained in the lower-molecular weight portion of the copolymer, and therefore, melting point of the propylene-α-olefin copolymer wax of the present invention does not become so high in spite of its relatively high molecular weight, which is a feature characteristic of the present invention. Accordingly, inclusion of such a wax in a developer material as a releasing agent would provide a material which is excellent in such properties as the fixing of the image on the paper and the offset resistance in a low temperature.

EXAMPLES

The present invention is described in further detail by referring to Examples of the present invention and Comparative Examples, which by no means limit the scope of the invention.

(Example 1) [Preparation of a propylene-ethylene copolymer wax]

A high-molecular weight propylene-ethylene copolymer (having a melt index of 20, a propylene content of 95% by mole, a degree of crystallinity of 60%, and an isotacticity (Iso) of 90%, which is hereinafter referred to as "PE-1") prepared by copolymerizing propylene and ethylene in the presence of a solid titanium catalyst comprising magnesium chloride having loaded thereon titanium was fed to a twin screw extruder (equipped with screws having a diammaleicof 30 mm), and extruded at a screw rotation rate of 25 rpm to thermally degrade the copolymer at 425° C. to thereby produce a Propylene-ethylene copolymer wax. The resulting Propylene-ethylene copolymer wax (which is hereinafter abbreviated as "PW-1") was determined for its number average molecular weight, $X_R$ and Iso. The results are shown in Table 1.

The $X_R$ was determined by using TSK gel GMH-HT, which is a GPC column manufactured by ToSo. The FT-IR was conducted by using 1769X-type FTIR manufactured by Perkin-Elmer Inc. by mounting therewith a quartz window flow cell having an optical path length of 1 mm. The determination was carried out at a column temperature of 140° C., a flow rate of 1 ml/min by using o-dichlorobenzene as the solvent, and introducing 1,000 μl of the sample solution at a concentration of 0.2% (w/v).

In determining the Iso, the $^{13}$C-NMR was conducted by using GX500 nuclear magnetic resonance apparatus manufactured by Nippon Electronics K.K.

[Preparation of Toner and Evaluation of Reprographic Properties]

To a ball mill were fed 85 parts by weight of styrene-n-butyl methacrylate copolymer (manufactured by Sanyo Chemical Industries, Ltd; Himer), 4 parts by weight of PW-1, 9 parts by weight of carbon black (manufactured by Mitsubishi Chemical Industries, Ltd.; DiaBlack SH) , and 2 parts by weight of a metallized dye (manufactured by BASF Inc.; Zabon-Fastblack B), and the mixture was milled in the ball mill for 24 hours. The mixture was then kneaded with heated rolls, cooled, finely divided, and classified to produce a developer material having an average particle size in the range of 13 to 15 μm.

A two-component electrostatic toner was prepared by mixing 120 parts by weight of the developer material with 100 parts by weight of iron powder carrier having an average particle size in the range of from 50 to 80 μm. The thus produced two-component electrostatic toner was evaluated for its reprographic properties by the following procedures. The results are shown in Table 2.

Fixing of Fixed Image

A test image was electrophotographically duplicated on a selenium photoreceptor and the duplicated image was developed by using the two-component electrostatic toner, and the developed image was transferred onto a receiving sheet of paper. The thus transferred image was fixed by using a fixing rollers having a surface formed of polytetrafluoroethylene (manufactured by DuPont Inc.) heated to a temperature of 200° C. backed with a pressure roller having a surface formed of a silicone rubber (manufactured by Shinetsu Chemical K.K.; KE-1300RTV). The resulting fixed image was rubbed on its surface for five times with a sand-mixed rubber eraser having a bottom face of 15 mm×7.5 mm, on which a load of 500 grams was placed. Optical reflection density (image density) was measured with reflection densitometer (manufactured by Macbeth Inc.) before and after the rubbing of the fixed image with the eraser, and the fixing of the fixed image was determined by the following equation:

$$\text{Fixing (\%)} = \frac{\text{(Image density after the rubbing)}}{\text{(Image density before the rubbing)}} \times 100$$

Temperature of Low-Temperature Offset Disappearance

A test image was electrographically duplicated on a selenium photoreceptor and the duplicated image was developed by using the two-component electrostatic toner, and the developed image was transferred onto a receiving sheet of paper. The thus transferred image was fixed by using a fixing roller having a surface formed of polytetrafluoroethylene (manufactured by Dupont Inc.) heated to a various temperature and a pressure roller having a surface formed of a silicone rubber (manufactured by Shinetsu Chemical K.K.; KE-1300 RTV). A receiving sheet of paper with no fixed image was pressed to the fixing roller in the above-described condition, and when low temperature offset phenomenon was disappeared, its temperature was determined to temperature of low-temperature offset disappearance.

Offset and Contamination of fixing roller

A test image was electrophotographically duplicated on a selenium photoreceptor and the duplicated image was developed by using the two-component electrostatic toner, and the developed image was transferred onto a receiving sheet of paper. The thus transferred image was fixed by using a fixing roller having a surface formed of polytetrafluoroethylene (manufactured by DuPont Inc.) heated to a temperature of 200° C. backed with a pressure roller having a surface formed of a silicone rubber (manufactured by Shinetsu Chemical K.K.; KE-1300RTV). The above-described reprographic procedure was repeated for 5,000 times, and the paper was evaluated for the offset, and the photoreceptor and the fixing roller were evaluated for contamination on their surface. Susceptibility for contamination of the photoreceptor and the fixing roller was visually evaluated in accordance with the following criteria.

◎: no contamination
○: little contamination
X : considerable contamination (Example 2)

A propylene-ethylene copolymer wax (hereinafter abbreviated as "PW-2") having a number average molecular weight (Mn) of 8,000 was produced by repeating the procedure of Example 1 except that the high-molecular weight propylene-ethylene copolymer, PE-1 was thermally degraded at a temperature of 420° C. The resulting PW-2 was evaluated for its $X_R$ and Iso. The results are shown in Table 1.

Next, an electrostatic toner was prepared by repeating the procedure of Example 1 except that PW-2 instead of PW-1 was used, and the resulting electrostatic toner was evaluated for its reprographic properties. The results are shown in Table 2.

(Example 3)

A propylene-ethylene copolymer wax (hereinafter abbreviated as "PW-3") having a number average molecular weight (Mn) of 11,000 was produced by repeating the procedure of Example 1 except that the high-molecular weight propylene-ethylene copolymer PE-1 was thermally degraded at a temperature of 400° C. The resulting PW-3 was evaluated for its $X_R$ and Iso. The results are shown in Table 1.

Next, an electrostatic toner was prepared by repeating the procedure of Example 1 except that PW-3 instead of pW-1 was used, and the resulting electrostatic toner was evaluated for its reprographic properties. The results are shown in Table 2.

(Comparative Example 1)

A propylene-ethylene copolymer wax (hereinafter abbreviated as "PW-4") having a number average molecular weight (Mn) of 4,000 was produced by repeating the procedure of Example 1 except that the high-molecular weight propylene-ethylene copolymer PE-1 was thermally degraded at a temperature of 450° C. The resulting PW-4 was evaluated for its $X_R$ and Iso. The results are shown in Table 1.

Next, an electrostatic toner was prepared by repeating the procedure of Example 1 except that PW-4 instead of PW-1 was used, and the resulting electrostatic toner was evaluated for its reprographic properties. The results are shown in Table 2.

(Comparative Example 2)

A propylene-ethylene copolymer wax (hereinafter abbreviated as "PW-5") having a number average molecular weight (Mn) of 17,000 was produced by repeating the procedure of Example 1 except that the high-molecular weight propylene-ethylene copolymer PE-1 was thermally degraded at a temperature of 380° C. The resulting PW-5 was evaluated for its $X_R$ and Iso. The results are shown in Table 1.

Next, an electrostatic toner was prepared by repeating the procedure of Example 1 except that PW-5 instead of PW-1 was used, and the resulting electrostatic toner was evaluated for its reprographic properties. The results are shown in Table 2.

(Comparative Example 3)

A propylene-ethylene copolymer wax (hereinafter abbreviated as "PW-6") having a number average molecular weight (Mn) of 8,000 was produced by repeating the procedure of Example 1 except that a high-molecular weight propylene-ethylene copolymer (having a melt index of 20, a propylene content of 95% by mole, a degree of crystallinity of 58%, and an isotacticity (Iso) of 87%, which is hereinafter referred to as "PE-2") prepared by copolymerzing propylene and ethylene in the presence of a $TiCl_3.1/3AlCl_3$ and $AlEtl_{1.5}Cl_{1.5}$ was used instead of PE-1. The resulting PW-6 was evaluated for its $X_R$ and Iso. The results are shown in Table 1.

Next, an electrostatic toner was prepared by repeating the procedure of Example 1 except that PW-6 instead of PW-1 was used, and the resulting electrostatic toner was evaluated for its reprographic properties. The results are shown in Table 2.

TABLE 1

| | Propylene-α-olefin copolymer wax | Number average molecular weight | $X_R$ | Iso |
|---|---|---|---|---|
| Example 1 | PW-1 | 7,000 | 1.90 | 90.9 |
| Example 2 | PW-2 | 8,000 | 1.94 | 90.8 |
| Example 3 | PW-3 | 11,000 | 2.09 | 90.5 |
| Comparative Example 1 | PW-4 | 4,000 | 1.68 | 88.1 |
| Comparative Example 2 | PW-5 | 13,000 | 2.17 | 90.0 |
| Comparative Example 3 | PW-6 | 8,000 | 1.50 | 86.9 |

Note 1)
$X_R = X_L/X_H$
($X_L$: average ethylene content of the lower-molecular weight portion; $X_H$: average ethylene content of the lower-molecular weight portion)
Note 2)
Iso: isotacticity determined by $^{13}$C-NMR

TABLE 2

| | Propylene-α-olefin copolymer wax | Properties of Toner: Fixing of fixed image | Temp. of low-temp. offset disappearance, °C. | Offset | Contamination of photoreceptor and roller |
|---|---|---|---|---|---|
| Example 1 | PW-1 | 89.1 | 149 | None | ◎ |
| Example 2 | PW-2 | 91.3 | 149 | None | ◎ |
| Example 3 | PW-3 | 93.7 | 151 | None | ◎ |
| Comparative Example 1 | PW-4 | 76.5 | 148 | None | ○ |
| Comparative Example 2 | PW-5 | 94.1 | 156 | Some | ○ |
| Comparative Example 3 | PW-6 | 89.7 | 158 | Some | X |

INDUSTRIAL UTILITY

The thermal fixing-type developer material for electrophotography in accordance with the present invention is capable of providing a reprographic image which exhibits good release properties upon thermal fixing, a reduced adhesion to the heated roller or the photoreceptor, no offset or contamination, and a good fixing of the fixed image. Furthermore, use of the developer material of the present invention would prevent the heated roll and the photoreceptor from undergoing a contamination. Therefore, the developer material of the present invention is quite preferable as a main component for an electrostatic toner.

We claim:

1. A thermal fixing developer material for electrophotography comprising (A) a propylene-α-olefin copolymer wax having a number average molecular weight (Mn) in the range of from 7,000 to 12,000, said α-olefin in said propylene-α-olefin copolymer wax comprising at least one member selected from the group consisting of ethylene and α-olefins having 4 to 6 carbon atoms, said propylene-α-olefin copolymer wax having a propylene content of at least 90 mole%, said propylene-α-olefin copolymer wax comprising a lower molecular weight portion and a remaining higher molecular weight portion and having a ratio $X_R$ of $X_L/X_H$ in the range of from 1.80 to 2.50, $X_L$ representing an average α-olefin content of the lower molecular weight portion and $X_H$ representing an average α-olefin content of the remaining higher molecular weight portion:

(B) a binder; and (C) a colorant.

2. The thermal fixing developer material for electrophotography according to claim 1, wherein said ratio $X_R$ is in the range of from 1.80 to 2.40.

3. The thermal fixing developer material for electrophotogaphy according to claim 1, wherein said propylene-α-olefin copolymer wax has a number average molecular weight in the range of from 7,500 to 10,000.

4. The thermal fixing developer material for electrophotography according to claim 1, wherein said propylene-α-olefin copolymer wax is a propylene-ethylene copolymer wax having an isotacticity of at least 88%.

5. The thermal fixing developer material for electrophotography according to claim 1, wherein said binder comprises a thermoplastic resin.

6. The thermal fixing developer material for electrophotography according to claim 5, wherein said thermoplastic resin is selected from the group consisting of a styrene polymer, a ketone resin, a maleic acid resin, an aliphatic polyester resin, an aromatic polyester resin, a coumaron resin, a phenol resin, an epoxy resin, a terpene resin, a polyvinyl butyral, a polybutyl methacrylate, a polyvinyl chloride, a polyethylene, a polypropylene, a polybutadiene and an ethylene-vinyl acetate copolymer.

7. The thermal fixing developer material for electrophotography according to claim 6, wherein said thermoplastic resin is a styrene polymer comprising a styrene monomer and another vinyl monomer.

8. The thermal fixing developer material for electrophotography according to claim 7, wherein said styrene polymer has a number average molecular weight of at least 2,000.

9. The thermal fixing developer material for electrophotography according to claim 8, wherein said styrene polymer has a number average molecular weight of from 3,000 to 30,000.

10. The thermal fixing developer material for electrophotography according to claim 7, wherein said styrene monomer is present in an amount of at least 25% by weight.

11. The thermal fixing developer material for electrophotography according to claim 1, wherein said colorant is selected from the group consisting of pigments and dyes.

12. The thermal fixing developer material for electrophotography according to claim 1, wherein said colorant is selected from the group consisting of carbon black, phthalocyanine blue, aniline blue, arcooil blue, chrome yellow, ultramarine blue, quinoline yellow, lamp black, rose Bengal, diazo yellow, rhodamine B lake, carmine 6B, quinacridones and mixtures thereof.

13. The thermal fixing developer material for electrophotography according to claim 1, wherein the propylene-α-olefin copolymer wax/binder/colorant weight ratio is 1 to 20/100/1 to 20.

14. The thermal fixing developer material for electrophotography according to claim 13, wherein said weight ratio is 1 to 10/100/1 to 10.

* * * * *